US008393286B2

(12) United States Patent
Rooney, III et al.

(10) Patent No.: US 8,393,286 B2
(45) Date of Patent: Mar. 12, 2013

(54) HULL ROBOT GARAGE

(75) Inventors: James H. Rooney, III, Harvard, MA (US); Jonathan T. Longley, Andover, MA (US); Brian R. Boule, Woburn, MA (US)

(73) Assignee: Raytheon Company, Waltham, MA (US)

( * ) Notice: Subject to any disclaimer, the term of this patent is extended or adjusted under 35 U.S.C. 154(b) by 377 days.

(21) Appl. No.: 12/586,248

(22) Filed: Sep. 18, 2009

(65) Prior Publication Data

US 2011/0067615 A1 Mar. 24, 2011

(51) Int. Cl.
*B63B 59/00* (2006.01)

(52) U.S. Cl. ..... 114/221 R; 114/222

(58) Field of Classification Search ..... 114/5–8, 114/238, 239, 258–262, 221 R, 222, 201 R, 114/313, 322; 320/109; 405/192–194
See application file for complete search history.

(56) References Cited

U.S. PATENT DOCUMENTS

| | | | | |
|---|---|---|---|---|
| 2,104,062 | A | | 1/1938 | Temple |
| 2,132,661 | A | | 10/1938 | Temple |
| 2,386,650 | A | * | 10/1945 | Bell ..... 114/259 |
| 3,088,429 | A | | 5/1963 | Johannessen |
| 3,285,676 | A | | 11/1966 | Hetteen |
| 3,439,937 | A | | 4/1969 | Dixon |
| 3,554,300 | A | | 1/1971 | Rosenberg |
| 3,638,600 | A | | 2/1972 | Modrey |
| 3,777,834 | A | | 12/1973 | Hiraoka et al. |
| 3,922,991 | A | | 12/1975 | Woods |
| 3,934,664 | A | | 1/1976 | Pohjola |
| 3,946,692 | A | | 3/1976 | Sierra et al. |
| 3,960,229 | A | | 6/1976 | Shio |
| 3,984,944 | A | | 10/1976 | Maasberg et al. |
| 4,046,429 | A | | 9/1977 | Pohjola |
| 4,079,694 | A | | 3/1978 | Galinou |
| 4,119,356 | A | | 10/1978 | Pohjola |
| 4,135,592 | A | | 1/1979 | Vincent |
| 4,202,453 | A | | 5/1980 | Wilkes et al. |
| 4,251,791 | A | | 2/1981 | Yanagisawa et al. |
| 4,401,048 | A | | 8/1983 | Rogers |
| 4,574,722 | A | | 3/1986 | Orita et al. |
| 4,674,949 | A | | 6/1987 | Kroczynski |
| 4,690,092 | A | | 9/1987 | Rabuse |
| 4,697,536 | A | | 10/1987 | Hirata |
| 4,734,954 | A | | 4/1988 | Greskovics et al. |

(Continued)

FOREIGN PATENT DOCUMENTS

| | | |
|---|---|---|
| DE | 3611750 | 10/1987 |
| GB | 2038721 A | 7/1980 |

(Continued)

OTHER PUBLICATIONS

Written Opinion of the International Searching Authority, International Application No. PCT/US2010/002163, Oct. 13, 2010, 5 pgs. (unnumbered).

(Continued)

*Primary Examiner* — Edwin Swinehart
(74) *Attorney, Agent, or Firm* — Thorpe North & Western LLP

(57) ABSTRACT

A vessel hull robot garage includes a stowage compartment for stowing a hull robot and a rotation system for rotating the stowage compartment relative to the vessel between a launch/recovery attitude and a stowed position.

22 Claims, 13 Drawing Sheets

U.S. PATENT DOCUMENTS

| | | | | |
|---|---|---|---|---|
| 4,736,826 | A | 4/1988 | White et al. | |
| 4,789,037 | A | 12/1988 | Kneebone | |
| 4,809,383 | A | 3/1989 | Urakami | |
| 4,841,894 | A | 6/1989 | Nellessen, Jr. | |
| 4,890,567 | A | 1/1990 | Caduff | |
| 4,926,775 | A | 5/1990 | Andorsen | |
| 5,048,445 | A | 9/1991 | Lever et al. | |
| 5,174,222 | A | 12/1992 | Rogers | |
| 5,203,646 | A | 4/1993 | Landsberger et al. | |
| 5,249,631 | A | 10/1993 | Ferren | |
| 5,253,605 | A * | 10/1993 | Collins | 114/259 |
| 5,253,724 | A | 10/1993 | Prior | |
| 5,285,601 | A | 2/1994 | Watkin et al. | |
| 5,366,038 | A | 11/1994 | Hidetsugu et al. | |
| 5,435,405 | A | 7/1995 | Schempf et al. | |
| 5,628,271 | A | 5/1997 | McGuire | |
| 5,849,099 | A | 12/1998 | McGuire | |
| 5,852,984 | A | 12/1998 | Matsuyama et al. | |
| 5,894,901 | A | 4/1999 | Awamura et al. | |
| 5,947,051 | A | 9/1999 | Geiger | |
| 6,000,484 | A | 12/1999 | Zoretich et al. | |
| 6,053,267 | A | 4/2000 | Fisher | |
| 6,064,708 | A | 5/2000 | Sakamaki | |
| 6,102,145 | A | 8/2000 | Fisher | |
| 6,125,955 | A | 10/2000 | Zoretich et al. | |
| 6,317,387 | B1 | 11/2001 | D'Amaddio et al. | |
| 6,564,815 | B2 | 5/2003 | McGuire | |
| 6,595,152 | B2 | 7/2003 | McGuire | |
| 6,698,376 | B2 | 3/2004 | Delahousse et al. | |
| 6,792,335 | B2 | 9/2004 | Ross et al. | |
| 6,886,486 | B2 | 5/2005 | Van Rompay | |
| 6,886,651 | B1 | 5/2005 | Slocum et al. | |
| 7,296,530 | B1 | 11/2007 | Bernstein et al. | |
| 7,390,560 | B2 | 6/2008 | Wallach | |
| 7,520,356 | B2 | 4/2009 | Sadegh et al. | |
| 7,866,421 | B2 | 1/2011 | Moore et al. | |
| 7,934,575 | B2 | 5/2011 | Waibel et al. | |
| 2003/0000445 | A1 | 1/2003 | McGuire | |
| 2004/0089216 | A1 | 5/2004 | Van Rompay | |
| 2004/0133999 | A1 | 7/2004 | Walton | |
| 2005/0027412 | A1 | 2/2005 | Hobson et al. | |
| 2005/0156562 | A1 | 7/2005 | Cohen et al. | |
| 2005/0216125 | A1 | 9/2005 | Huston et al. | |
| 2006/0175439 | A1 | 8/2006 | Steur et al. | |
| 2006/0191457 | A1 | 8/2006 | Murphy | |
| 2006/0249622 | A1 | 11/2006 | Steele | |
| 2006/0261772 | A1 | 11/2006 | Kim | |
| 2007/0089916 | A1 | 4/2007 | Lundstrom | |
| 2007/0276552 | A1 | 11/2007 | Rodocker et al. | |
| 2007/0284940 | A1 | 12/2007 | Koolhiran | |
| 2008/0202405 | A1 | 8/2008 | Kern | |
| 2008/0276407 | A1 | 11/2008 | Schnittman et al. | |
| 2008/0281470 | A1 | 11/2008 | Gilbert, Jr. et al. | |
| 2009/0078484 | A1 | 3/2009 | Kocijan | |
| 2009/0094765 | A1 | 4/2009 | Osaka et al. | |
| 2009/0166102 | A1 | 7/2009 | Waibel et al. | |
| 2009/0301203 | A1 | 12/2009 | Brussieux | |
| 2010/0000723 | A1 | 1/2010 | Chambers | |
| 2010/0131098 | A1 | 5/2010 | Rooney, III et al. | |
| 2010/0217436 | A1 | 8/2010 | Jones et al. | |
| 2010/0219003 | A1 | 9/2010 | Rooney, III et al. | |

FOREIGN PATENT DOCUMENTS

| | | | |
|---|---|---|---|
| WO | WO 02/074611 | A2 | 9/2002 |
| WO | WO 02/074611 | A3 | 9/2002 |
| WO | WO 2005/014387 | A1 | 2/2005 |

OTHER PUBLICATIONS

Written Opinion of the International Searching Authority, International Application No. PCT/US2010/002164, Oct. 8, 2010, 5 pgs. (unnumbered).

Written Opinion of the International Searching Authority, International Application No. PCT/US2011/000787, Jul. 20, 2011, 7 pgs. (unnumbered).

Written Opinion of the International Searching Authority, International Application No. PCT/US2011/000770, Aug. 9, 2011, 5 pgs. (unnumbered).

Written Opinion of the International Searching Authority, International Application No. PCT/US2010/002693, Dec. 9, 2010, 8 pgs. (unnumbered).

U.S. Appl. No. 12/800,174, filed May 10, 2010; James H. Rooney III; notice of allowance dated Aug. 17, 2012.

U.S. Appl. No. 12/313,643, filed Nov. 21, 2008; James H. Rooney III; office action dated Sep. 17, 2012.

U.S. Appl. 12/587,949, filed Oct. 14, 2009; Howard R. Kornstein; office action issued May 25, 2012.

U.S. Appl. No. 12/800,174, filed May 10, 2010; James H. Rooney, III; office action issued Feb. 24, 2012.

Townsin, R.L., The Ship Hull Fouling Penalty, Biofouling, Jan. 2003, vol. 19, (supplement), Jan. 1, 2003, pp. 9-15.

Rosenhahn et al., Advanced Nanostructures for the Control of Biofouling: The FP6 EU Integrated Project AMBIO, Biointerphases vol. 3, No. 1 Mar. 2008, published Feb. 21, 2008; pp. IR1-IR5.

Yuan, et al., The Design of Underwater Hull-Cleaning Robot, Journal of Marine Science and Application, vol. 3, No. 1, Jun. 2004, pp. 41-45.

Fernandez, Linda, NAFTA and Member Country Strategies for Maritime Trade and Marine Invasive Species, Journal of Environmental Management 89, 2008, pp. 308-321.

Munk, Torben, Fuel Conservation Through Managing Hull Resistance, Motorship Propulsion Conference, Copenhagen, Apr. 26, 2006 pp. 1-10.

Kohli, Nikita, Biofouling and Design of a Biomimetic Hull-Grooming Tool, Naval Surface Warfare Center Carderock Division, West Bethesda, MD, NSWCCD-CISD-2007/002, Ship Systems Integration & Design Department Technical Report, Sep. 2007, 38 pages total.

U.S. Appl. No. 12/800,174, filed May 10, 2010, Rooney III, et al.

U.S. Appl. No. 12/800,486, filed May 17, 2010, James H. Rooney, III.

U.S. Appl. No. 12/313,643, Rooney et al.

HISMAR *Hull Identification System for Maritime Autonomous Robots*, http://hismar.ncl.ac.uk/public_docs/HISMAR_Poster.pdf (1 page).

HISMAR *HISMAR News Report* No. 2. 2008, http://hismar.ncl.ac.uk/public_docs/News_Reports/News%20Report%20Report%20No2_UNEW.pdf (4 pages).

S. Reed, A. Cormack, K. Hamilton, I. Tena Ruiz, and D. Lane. "*Automatic Ship Hull Inspection using Unmanned Underwater Vehicles*," Proceedings from the 7th International Symposium on Technology and the Mine Problem. Monterey, USA. May, 2006 (10 pages).

Vaganay, J., Elkins, M., Espositio, D., Oapos, Halloran, W., Hover, F., Kokko, M. *Ship Hull Inspection with the HAUV: US Navy and NATO Demonstrations Results*, OCEANS 2006, vol., Issue, Sep. 18-21, 2006, pp. 1-6.

Lee Min Wai Serene and Koh Cheok Wei, "Design of a Remotely Operated Vehicle (ROV) for Underwater Ship Hull Cleaning," National University of Singapore, 2003, pp. 1-6.

Fu-cai et al., "The Design of Underwater Hull-Cleaning Robot," *Journal of Marine Science and Application*, vol. 3, No. 1, Jun. 2004, pp. 41-45.

U.S. Appl. No. 12/583,346, filed Aug. 19, 2009, Rooney III et al.

U.S. Appl. No. 12/587,949, filed Oct. 14, 2009, Komstein et al.

Written Opinion of the International Searching Authority for PCT Application No. PCT/US2009/006122 mailed Feb. 3, 2010 (seven (7) pages).

Borchardt, John, Grooming the Fleet, Mechanical Engineering, vol. 132/No. 4 Apr. 2010, pp. 33-35.

U.S. Appl. 12/587,949; filed Oct. 14, 2009; Howard R. Kornstein; notice of allowance dated Sep. 21, 2012.

U.S. Appl. 12/800486; filed May 17, 2010; James H. Rooney III; notice of allowance dated Sep. 21, 2012.

U.S. Appl. 12/583,346; filed Aug. 19, 2009; James H. Rooney III; office action dated Sep. 25, 2012.

* cited by examiner

HULL ROBOT GARAGE

FIELD OF THE INVENTION

This invention relates to a garage for a hull robot.

BACKGROUND OF THE INVENTION

The frictional resistance of a vessel hull as it moves through the water can constitute 45% to 90% of the total resistance and may be increased by 6% up to 80% due to the fouling of the hull by algae, sea grass, barnacles, and the like. An added resistance of 30% due to moderate bio-fouling of a tanker hull can increase the fuel consumption of the vessel by twelve tons per day. The result is added cost to operate the vessel and increased emissions.

Accordingly, there are a variety of methods employed to lower the chance of bio-fouling and/or to clean the hull of vessels. For example, hull paints and coatings are used in an effort to decrease the chance of bio-fouling, but such treatments do not always work reliably. See, for example, U.S. Pat. No. 7,390,560. Also, the vessel must be dry docked for an extensive period of time while the paint and/or coating is applied. There are also environmental concerns with anti-fouling paints and coatings.

Most prior hull cleaning robots suffer from several potential shortcomings. Typically, the robots are connected to a cable and powered and controlled by an on-board power supply and control subsystem and are able to operate only on a stationary vessel.

BRIEF SUMMARY OF THE INVENTION

More recently, an improved hull robot has been proposed in co-pending U.S. patent application Ser. No. 12/313,643, filed Nov. 21, 2008, by Rooney et al. There is a need for a place to store the robot when it is not in use or needs maintenance routine or otherwise. This robot uses magnetic attraction to grip the hull as the robot moves about the hull. The magnets required to safely secure the moving robot to the hull, especially when the vessel is underway, must exert a substantial force. It can be difficult to remove the robot from the hull for servicing, cleaning, and or storage. It may also be difficult to move a robot from storage onto the hull. The robot is often not easily launched and/or recovered by one man or even two in an ocean going environment. So, a more reliable launch and recovery technique is required. Further, safe stowage is always a consideration for equipment on a vessel. And, again, stowage is not without difficulty because of the size and weight of the robot. In addition, from time to time, the robot may need to be brought below to a maintenance shop for repair and/or maintenance.

In one embodiment a vessel hull robot garage includes a stowage compartment on the vessel for stowing a hull robot and a rotation system configured to rotate the stowage compartment relative to the vessel between a launch/recovery attitude and a stowed position.

In a preferred embodiment the rotation system may include a rotation mechanism and a drive system. The garage may include a cleaning fluid dispenser system for cleaning the robot. The garage may include cleaning implements for cleaning the robot. The garage may include a heater system. The garage may include a charging receptacle for engaging a matching receptacle on the robot for charging the robot power supply. The garage may include a charging and communication receptacle for receiving a matching receptacle on the robot for charging the robot power supply and communicating with an on board host controller and navigation system. The robot garage may be disposed on a water borne vessel deck and the launch/recovery attitude may be generally parallel to the surface of the hull and the stowed position may be generally parallel to the deck. The garage may include a floor of magnetic material. There may be a first spacer between the magnetic material and the robot to reduce any magnetic attraction between the robot and vessel. The first spacer may be non-magnetic material. The first spacer may be a keeper plate. The rotation system may include a hinge one portion of which is fixed to the garage, the other to the vessel. The garage may enclose the robot in the stowed position. The garage may include a door driven to move toward the open position as the stowage compartment approaches the launch/recovery attitude and toward the closed position as the stowage compartment approaches the stowed position. The garage may include a service chamber including at least one of a heater, a cleaning fluid dispenser system and a cleaning implement. The garage may include a releasably connected portable suitcase chamber. The stowage compartment may include a turntable for re-orienting the hull robot relative to the stowage compartment. The turntable may include a second rotation mechanism for rotating the turntable. The second rotation mechanism may be driven by the drive system. The first and second rotation mechanisms may each include a set of gears with a common shaft driven by the drive system.

In another embodiment a vessel hull robot garage includes a stowage compartment for stowing a hull robot, a rotation system for rotating the stowage compartment relative to the vessel between a launch/recovery attitude and a stowed position, a service chamber for receiving the hull robot for servicing during stowage, and a separate, portable suitcase chamber for extracting the robot from the garage.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
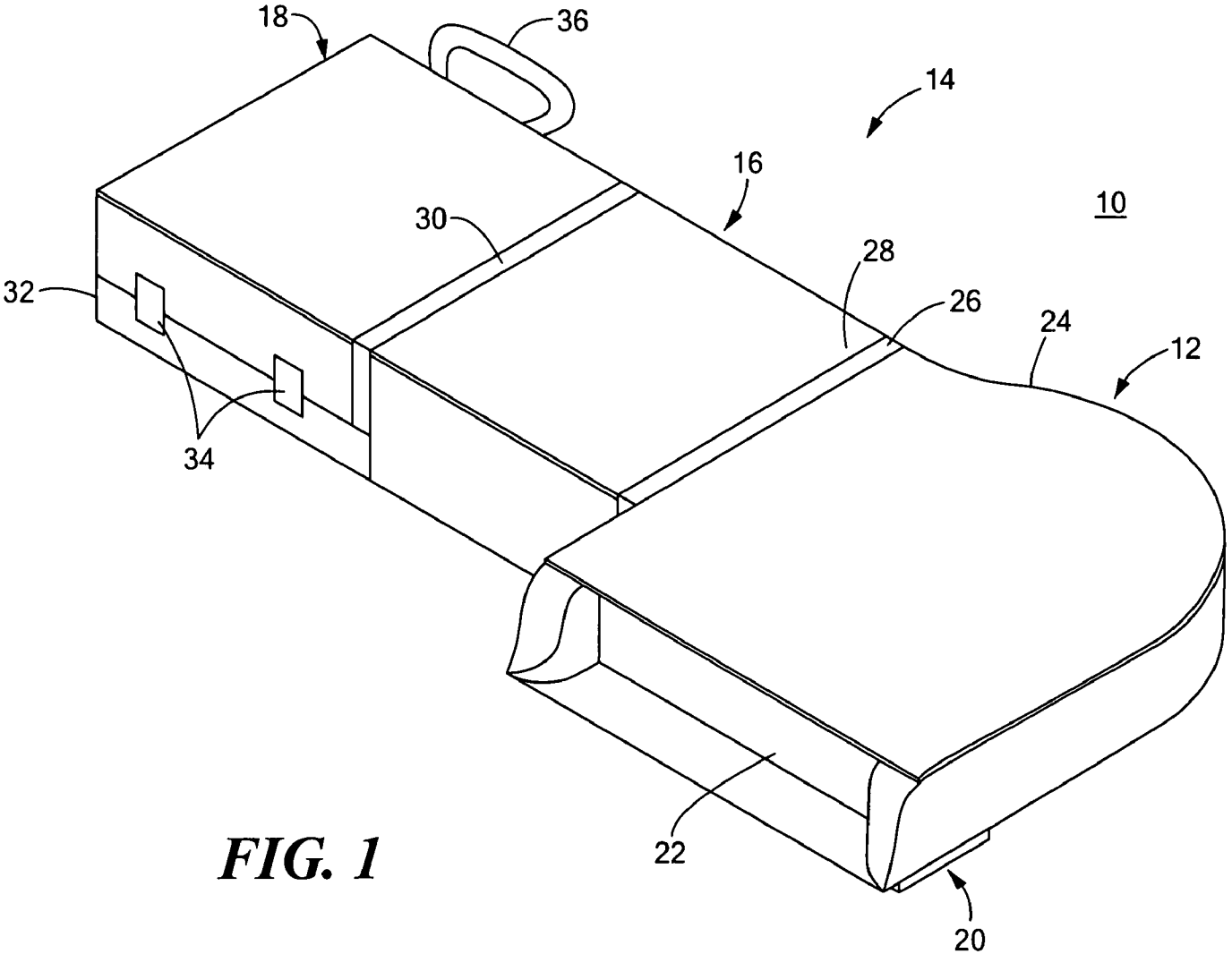
FIG. 1 is a diagrammatic three dimensional view of one example of a garage for a hull robot including a stowage compartment and an additional service compartment with the stowage compartment in the stowed position.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

There is shown in FIG. 1 an example of a vessel hull cleaning robot garage 10 including a stowage compartment 12. In one specific version, there is also a service chamber 14 connected to the stowage compartment 12 and in even more specific designs the service chamber 14 may include a cleaning station 16 and there may be further a separable portable suitcase chamber 18 for extracting the robot from garage 10. The service and suitcase chambers are optional and their functions as hereinafter described may be contained in the stowage compartment. Stowage compartment 12 is shown in the stowed position and includes a hinge mechanism 20 which allows it to be moved from the stowage position shown to a launch/recovery attitude. Door 22 is typically closed in the stowed position shown but is open in the launch/recovery attitude. Stowage compartment 12 includes a housing 24 with a sealing lip 26 that covers and seals about the edge 28 of service chamber 14. Sealing lip 26 overlaps the edge 28 of chamber 16 and may include an elastomeric or other sealing device. Chamber 14 may also include an overlapping portion 30 on the front side and top as shown for sealing chamber 14 to the portable suitcase chamber 18. Garage 10 may also include a base or mounting member 32 to which portable suitcase chamber 18 is releasably attached by, for example, latches 34 at the front and the back; only the back ones are shown in FIG. 1. A handle 36 may also be provided for ease of portability.

Figure 2:
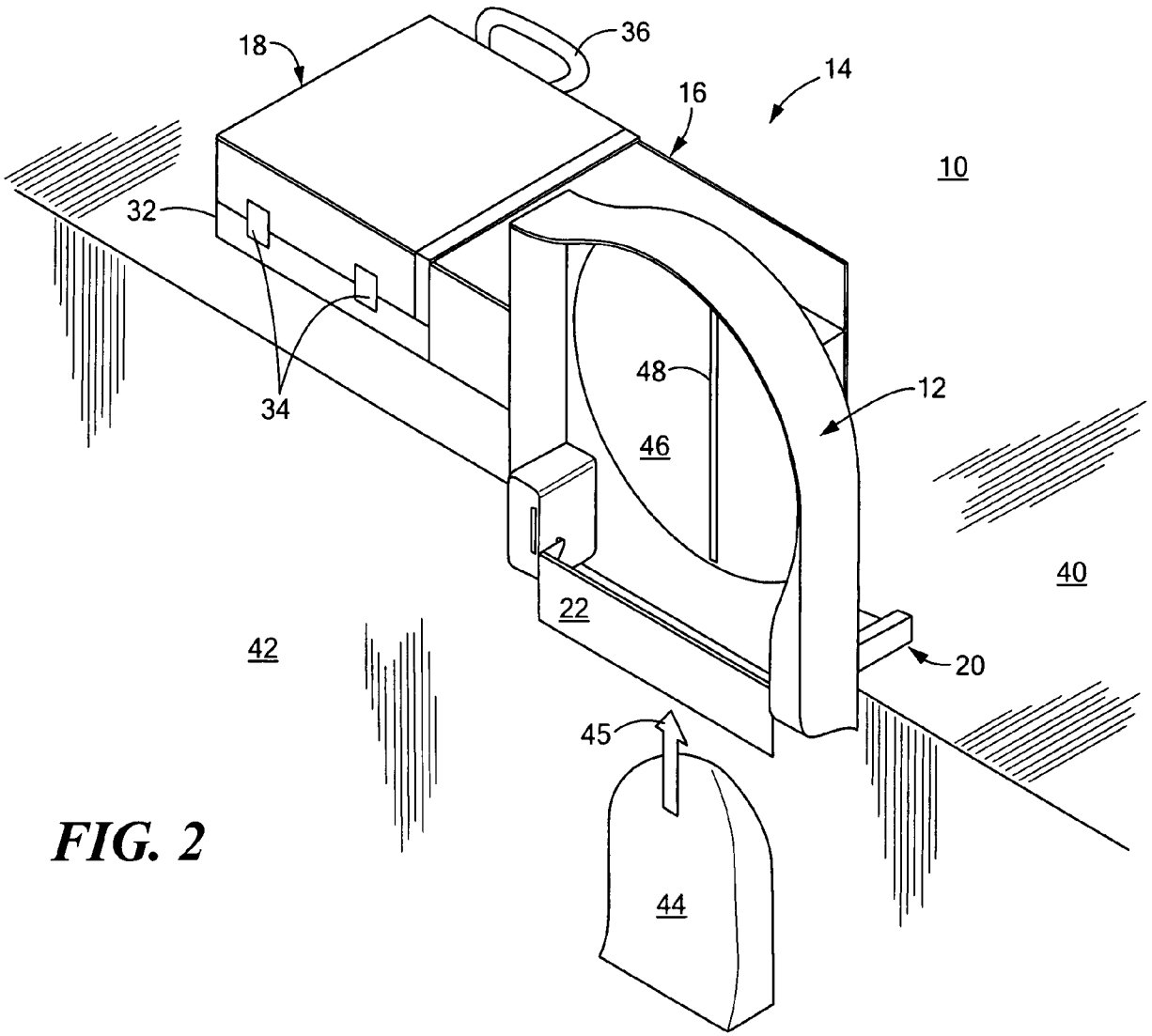
FIG. 2 is a view similar to FIG. 1 with the garage on the deck of a water borne vessel and in the launch/recovery attitude.
Figure 3:
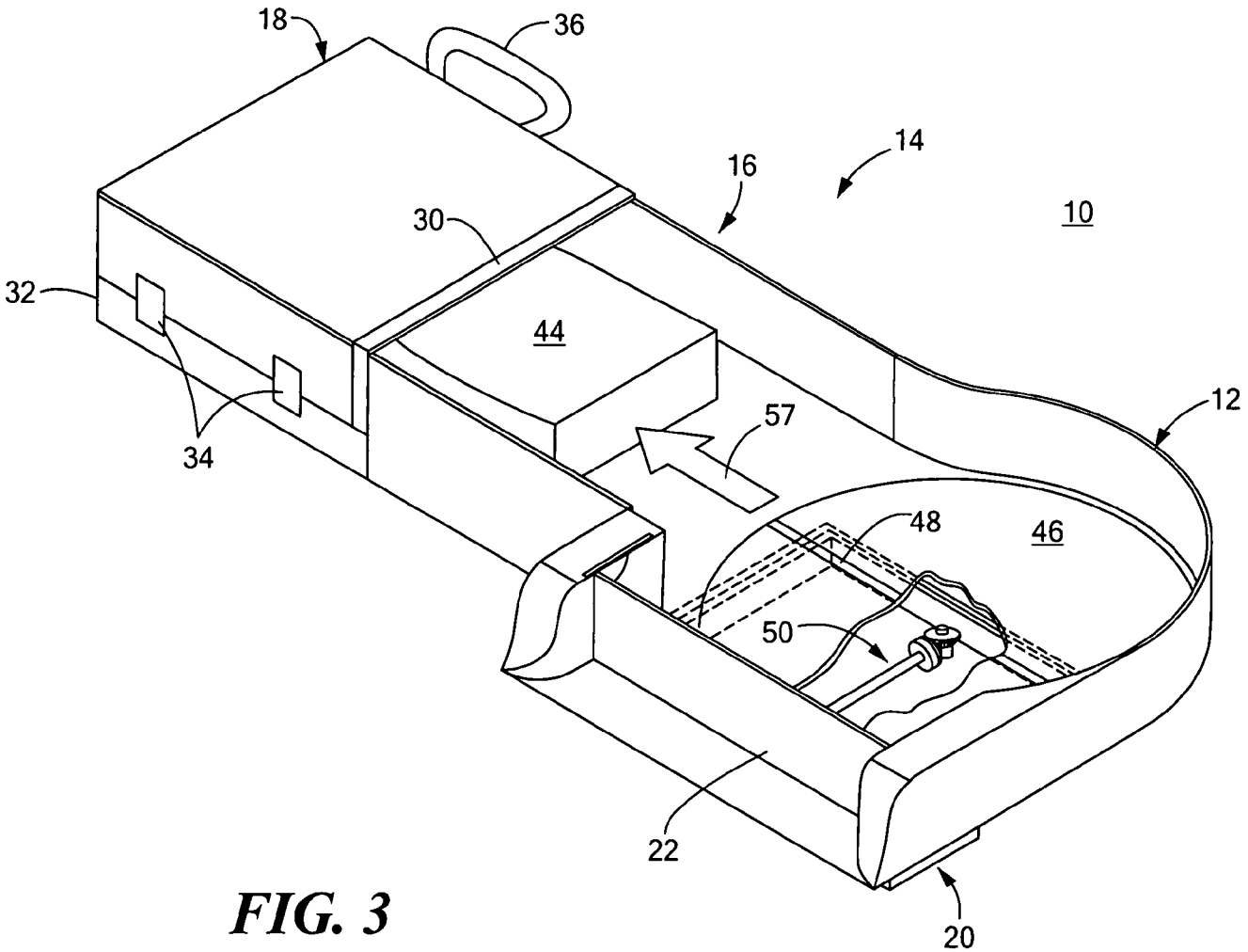
FIG. 3 is a view similar to FIG. 1 with covers removed.

In FIG. 2, garage 10 is shown mounted on the deck 40 of a waterborne vessel such as an ocean going ship. Stowage compartment 12 is now shown in the launch/recovery attitude generally parallel to the hull with the door 22 open and hull robot 44 approaching for recovery as shown by arrow 45. The subject invention, however, is not limited to any particular hull robot design. In FIG. 3, the covers of chamber 14 and stowage compartment 12 have been removed and there can be seen, therefore, in stowage compartment 12 turntable 46 with indexing line 48. The robot maneuvers into stowage compartment 12 after a hull cleaning cycle or at any time upon command. The robot climbs the hull and enters the stowage compartment 12 of garage 10 when it is in the launch/recovery attitude and the garage door 22 is open. Stowage compartment 12 is shown in the stowed position in FIG. 3 with turntable 46 already rotated 90° counter clock wise so that hull robot 44 can exit from stowage compartment 12 in the direction of arrow 57 into chamber 16 and eventually into portable suitcase chamber 18. The new orientation of turntable 48 can be seen by comparing the index lines 48 in FIGS. 2 and 3. Drive system 50 which can be used to rotate turntable 46 and move stowage compartment 12 between the stowed position and the launch/recovery attitude is made visible through the fictitious transparency of turntable 46 in the drawing. Once stowage compartment 12 reaches the stowed position and turntable has rotated 90° counter-clock wise, robot 44 moves as indicated by arrow 51 to enter the cleaning station 16 for fresh water washing where it will be rinsed with fresh water and may be brushed or other wise administered to. After the fresh water rinse, robot 44 may enter the portable suitcase chamber 18 where it will dock to engage the ships power to recharge its batteries. The covers have been removed from chamber 14 and stowage compartment 12 for ease of understanding.

Figure 4:
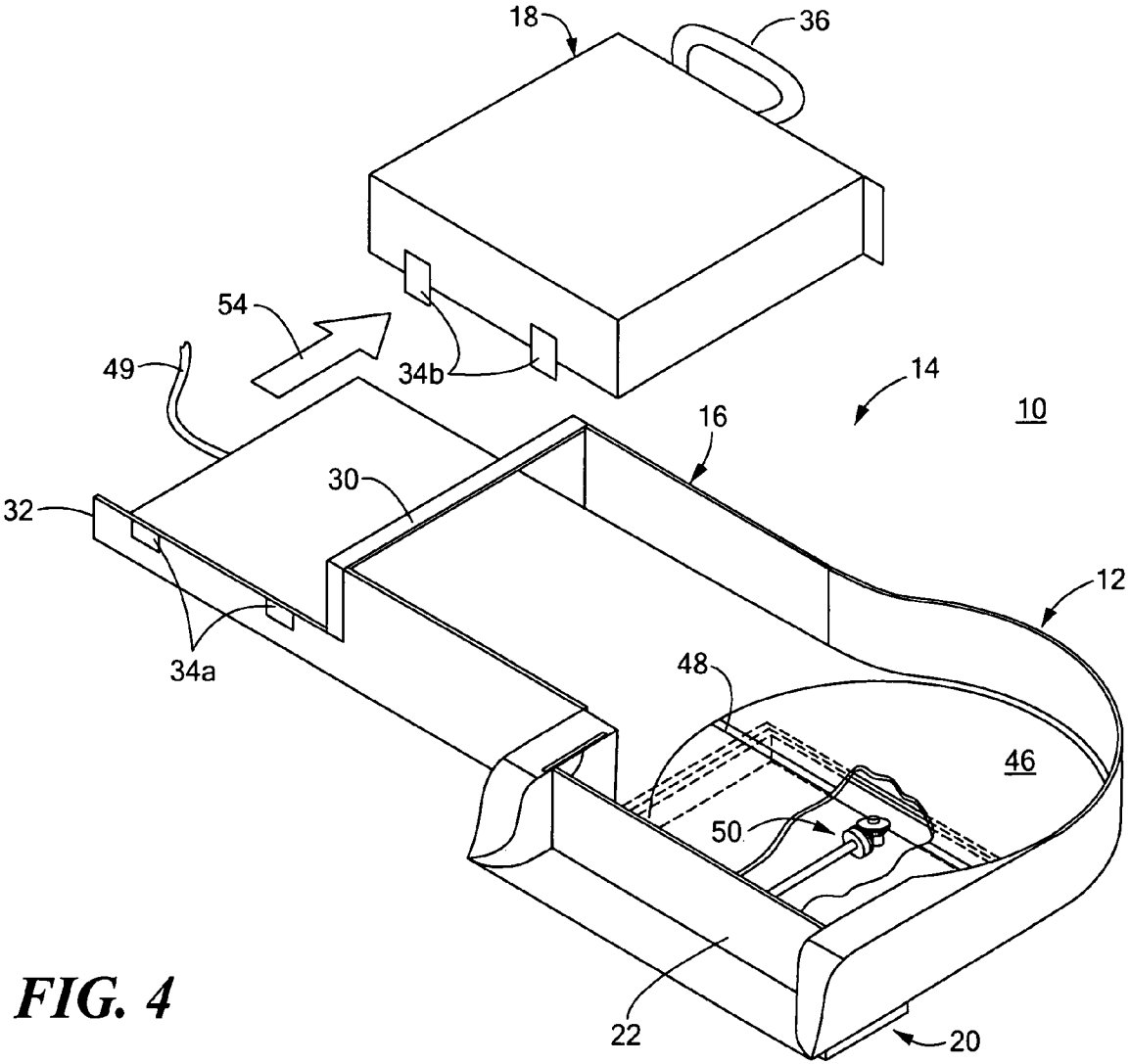
FIG. 4 is a view similar to FIG. 3 with a portable suitcase chamber removed from the garage.

By releasing latches 34 in two parts indicated at 34*a* on mounting 32 and parts 34*b* on suitcase chamber 18 on the front and back of portable suitcase chamber 18, chamber 18 may be slid off, FIG. 4, and removed using handle 36 to be brought below, for example, for maintenance. Suitcase chamber 18 may be removed by sliding in the direction as shown by arrow 54 by, for example, pulling on handle 36. The front portion 30*a* of sealing edge 30 is not affixed to chamber 14 but to suitcase chamber 18. The power for the docked charging station of suitcase chamber 18 as well as power to necessary cleaning elements in chamber 14 may be introduced through cable 49.

Figure 14:
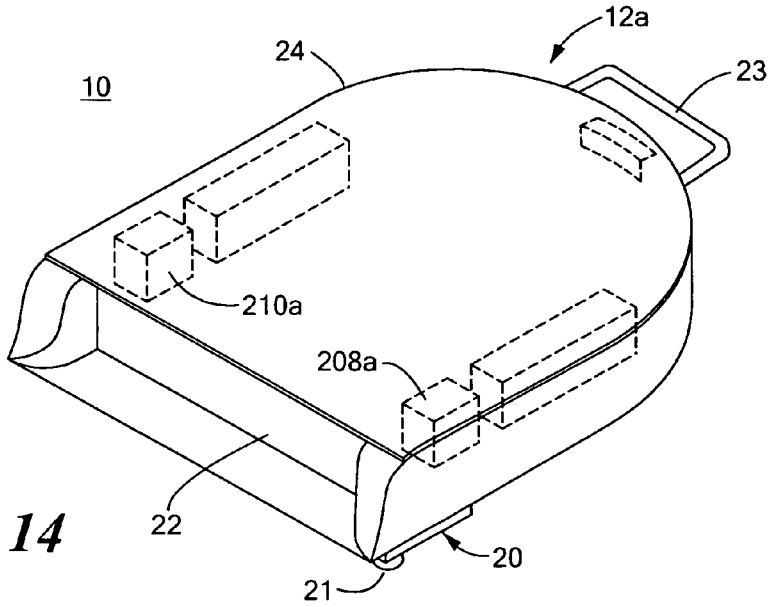
FIG. 14 is a three dimensional view of another embodiment.
Figure 15:
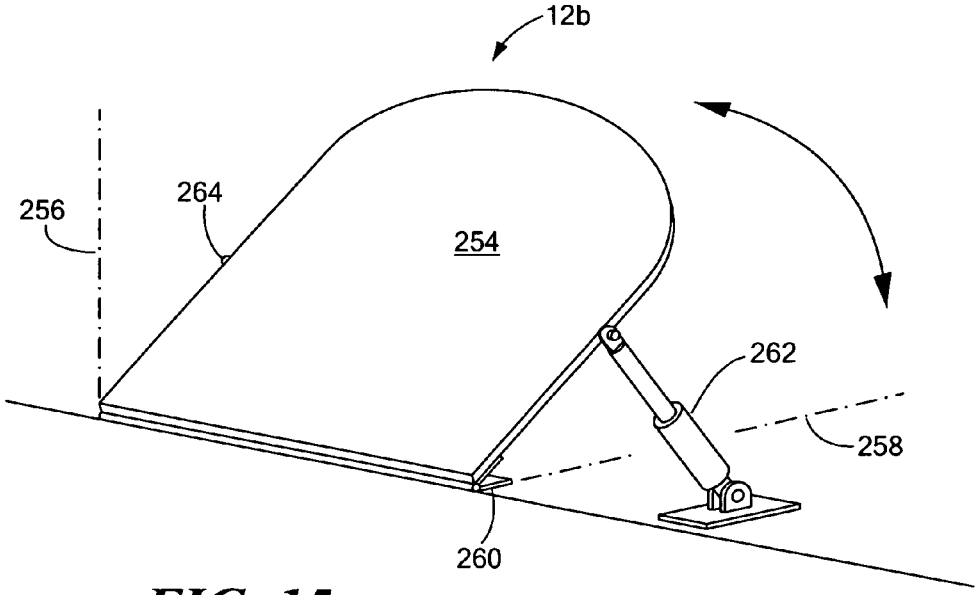
FIG. 15 is a three dimensional view of yet another embodiment.

The various functions provided by garage 10, e.g. heating, cleaning, charging portable removability have been distributed across the service 14 and suitcase 18 chambers in this particular embodiment in order to make the disclosure easier and more understandable but all of these functions could as well be provided in the stowage compartment and the service 14 and suitcase 18 chambers done away with as illustrated with respect to FIGS. 14 and 15, infra.

Figure 5:
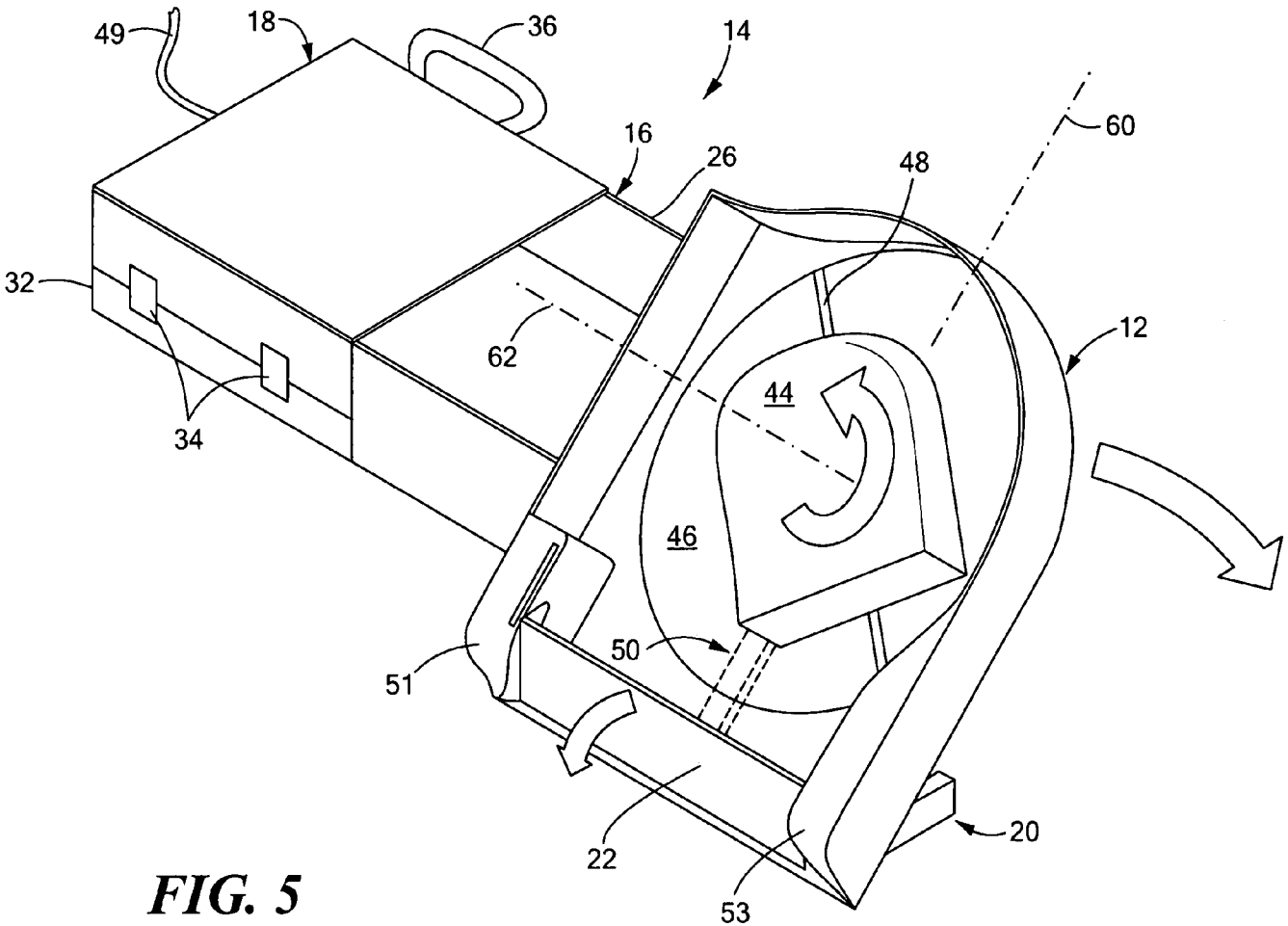
FIG. 5 is a view similar to FIG. 3 with the stowage compartment part way between the stowed position and the launch/recovery attitude.

The preferred synchronous operation of turntable 46 and stowage compartment 12 is shown in more detail in FIG. 5 where it can be seen that as stowage compartment 12 has been raised roughly halfway between the stowed position and the launch/recovery attitude, the turntable 46 has been rotated a similar proportion, about halfway, from its entry orientation indicated at 60 to its exit orientation 62 aligned with service chamber 14. Door 22 is swingably connected to pivot points in shrouds 51 and 53.

Figure 6:
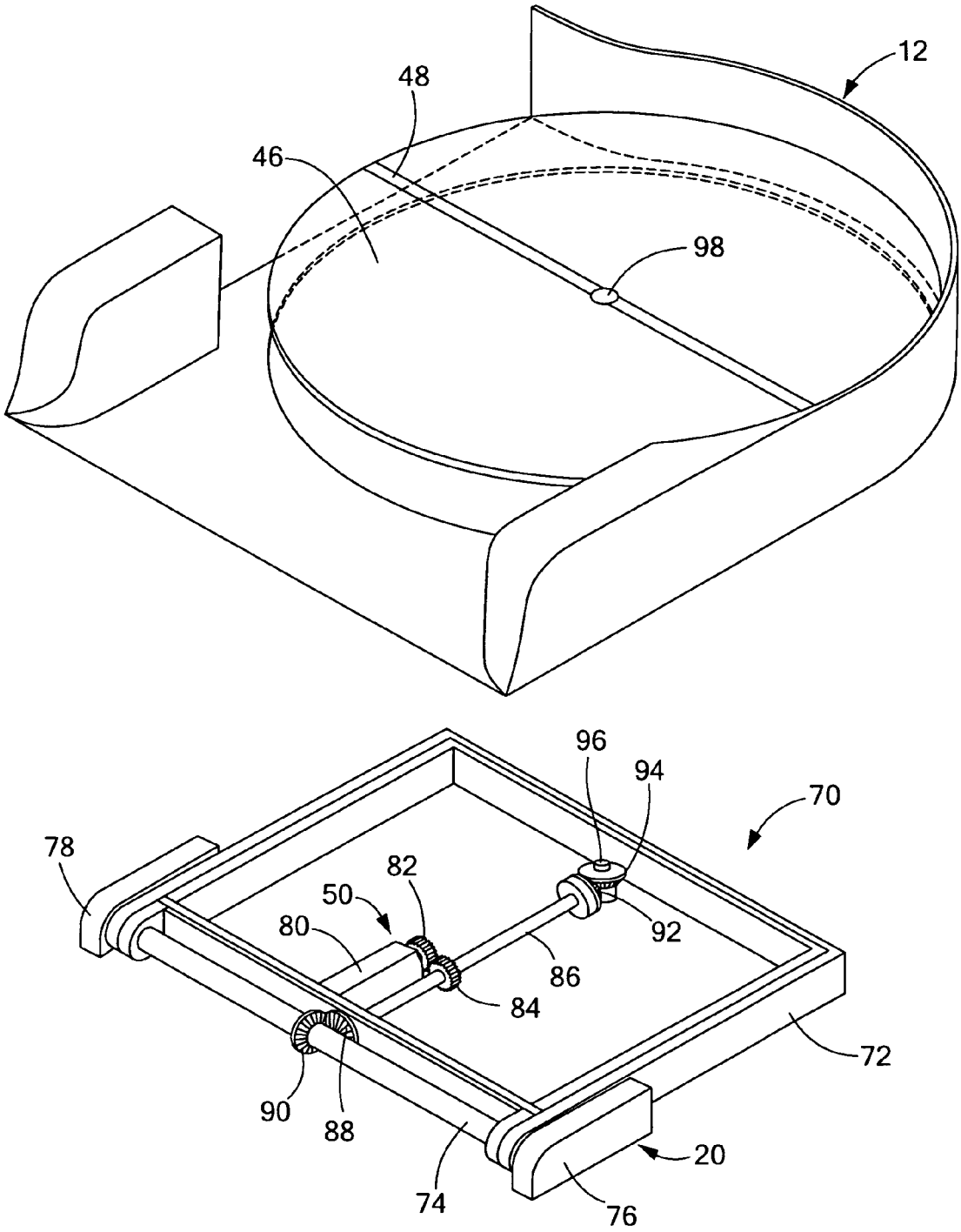
FIG. 6 is an exploded more detailed, three dimensional view of the rotational mechanism and the hinge mechanism of FIG. 5.

Stowage compartment 12 with its cover removed is shown exploded away from the rotating mechanism 70, FIG. 6. Rotation mechanism 70 includes hinge mechanism 20 and base 72. Base 72 is rotatable on hinge shaft 74 while hinge shaft 74 is fixed to hinge mountings 76 and 78 which are in turn attached to the vessel, e.g. to deck 40 using bolts, for example, FIG. 2. Drive system 50 includes motor 80, FIG. 6, which drives its output gear 82. Output gear 82 drives intermediate gear 84 which is fixed to drive shaft 86. Drive shaft 86 has one output gear 88 which drives gear 90 that is fixed to hinge shaft 74 which causes base 72 to rise or lower moving stowing compartment 12 accordingly. Shaft 86 also drives second output drive gear 92 which drives turntable gear 94 which rotates shaft 96 that is fixed as at 98 to turntable 46 to effect the rotation of turntable 46. Thus, when motor 80 is energized it simultaneously raises or lowers base 72 depending upon its direction of operation and synchronously rotates turntable 46 between the stowage orientation shown in FIG. 6 and a position 90° clock wise therefrom in the launch/recovery attitude as shown more clearly in FIG. 2.

Figure 7:
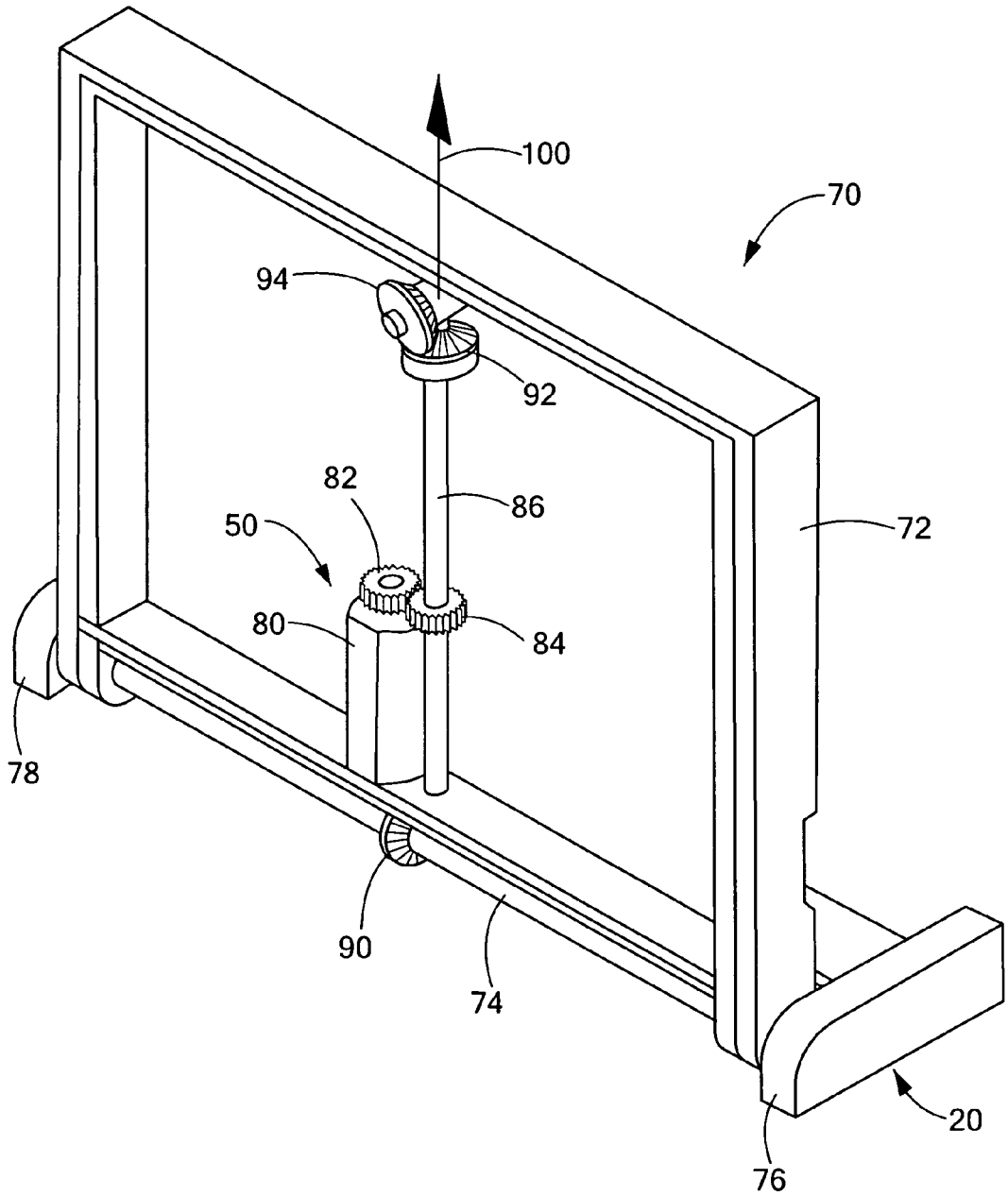
FIG. 7 is a three dimensional, diagrammatic view of the rotation mechanism, hinge mechanism and drive system of the stowage compartment in the launch/recovery attitude.
Figure 8:
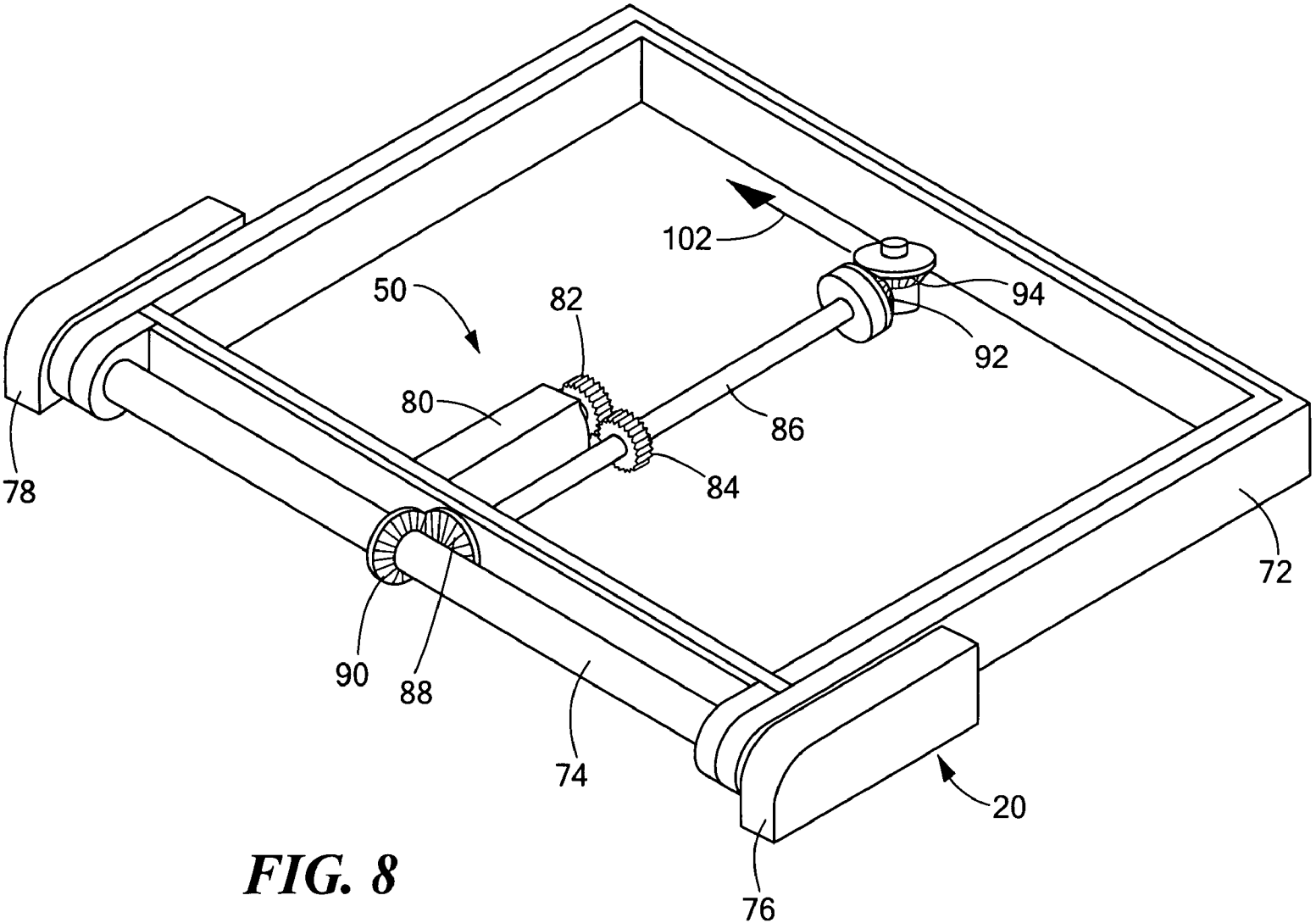
FIG. 8 is a three dimensional, diagrammatic view of the rotation mechanism, hinge mechanism and drive system of the stowage compartment in the stowed position.
Figure 9:
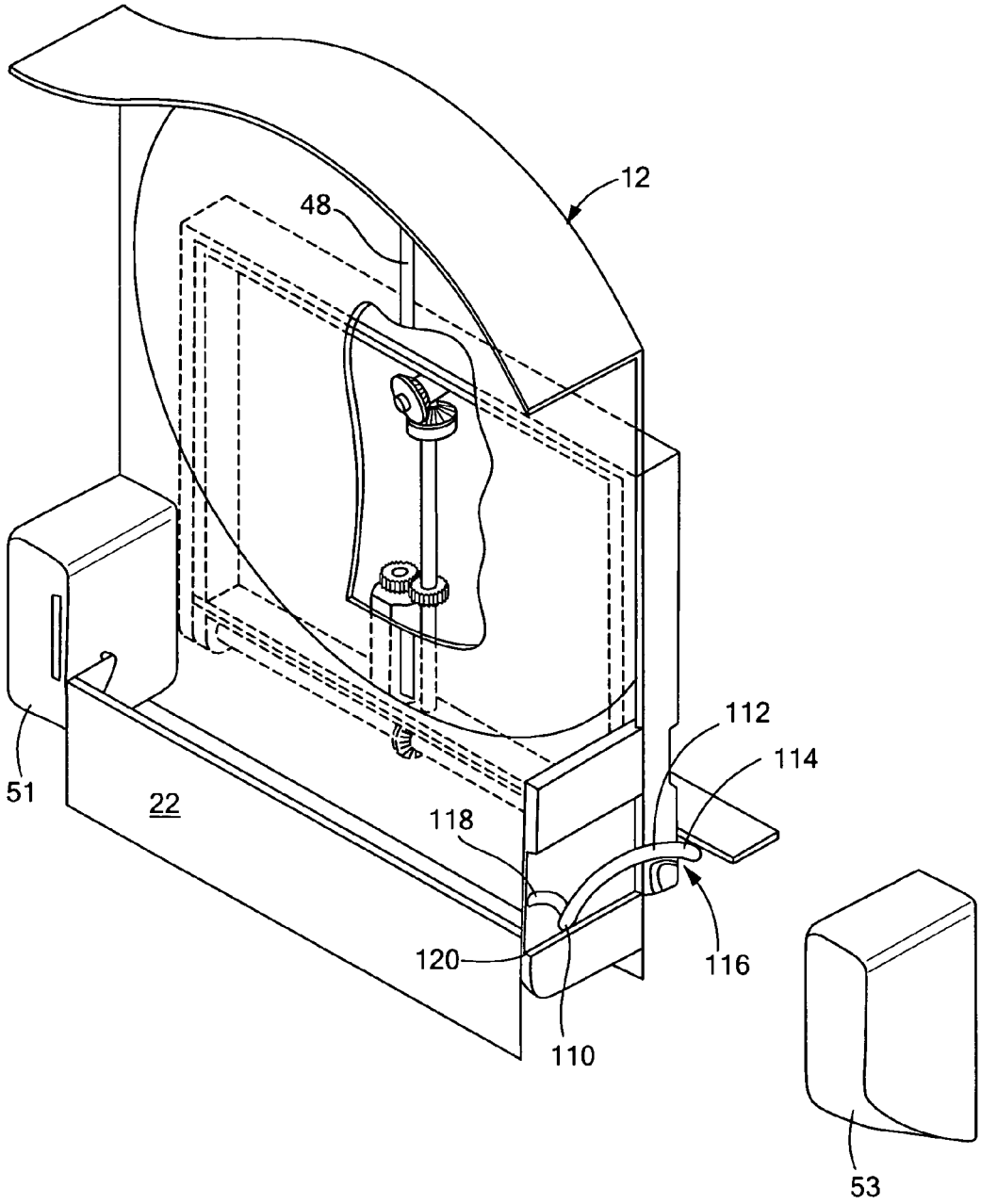
FIG. 9 is a three dimensional, diagrammatic view of the stowage compartment in the launch/recovery attitude with the door and linkage in the open position.
Figure 10:
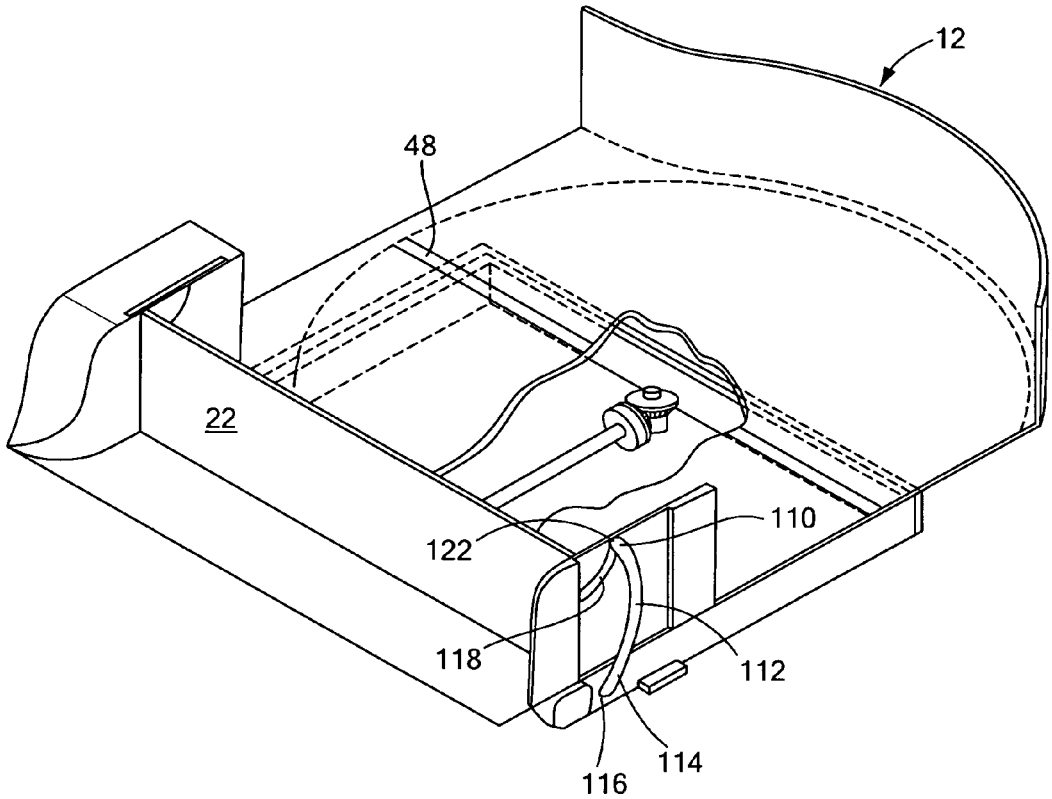
FIG. 10 is a three dimensional, diagrammatic view of the stowage compartment in the stowed position with the door and linkage in the closed position.

The synchronous operation can be seen more readily in FIGS. 7 and 8. In FIG. 7 base 72 is in the launch/recovery attitude and output gear 94 has an index mark provided on it for purposes of this discussion which is aligned with arrow 100. In FIG. 8 base 72 is in the stowed position and the alignment mark on output gear 94 is aligned with arrow 102, thus, in FIG. 7 the orientation of gear 94 matches that orientation of turntable 46 in FIG. 2. In FIG. 8 the alignment mark on gear 94 matches the orientation of turntable 46 in FIGS. 3 and 6. Cover 22, FIG. 9, is swingably supported in shrouds. Door 22 is swingably connected to inside shrouds 51 and 53, FIG. 9, (where shroud 53 has been removed) using a four bar linkage configured as follows. At least one of the pivot points of door 22 in shrouds 51 and 53 is connected to one end 110 of link 112 whose other end 114 is fixed at 116 to the base of garage 10. The end 110 of link 112 is enabled to move through arcuate slot 118 as stowage compartment 12 moves between the launch/recovery attitude as shown in FIG. 9 and the stowed position of FIG. 10. There it can be seen that the end of crank 110 is at one end 120 of slot 118, FIG. 9, when stowage compartment 12 is the launch/recovery attitude. In FIG. 10 that end 110 of crank 112 has moved to the other end 122 of slot 118. Thus, as stowage compartment 12 moves from the launch/recovery attitude of FIG. 9 to the stowed position of FIG. 10 door 22 is compelled to move from the open position in FIG. 9 to the closed position in FIG. 10 by the action of link 112 moving in slot 118. This ensures that salt water, ice or other materials that may interfere with the operation are barred from entry.

Figure 11:
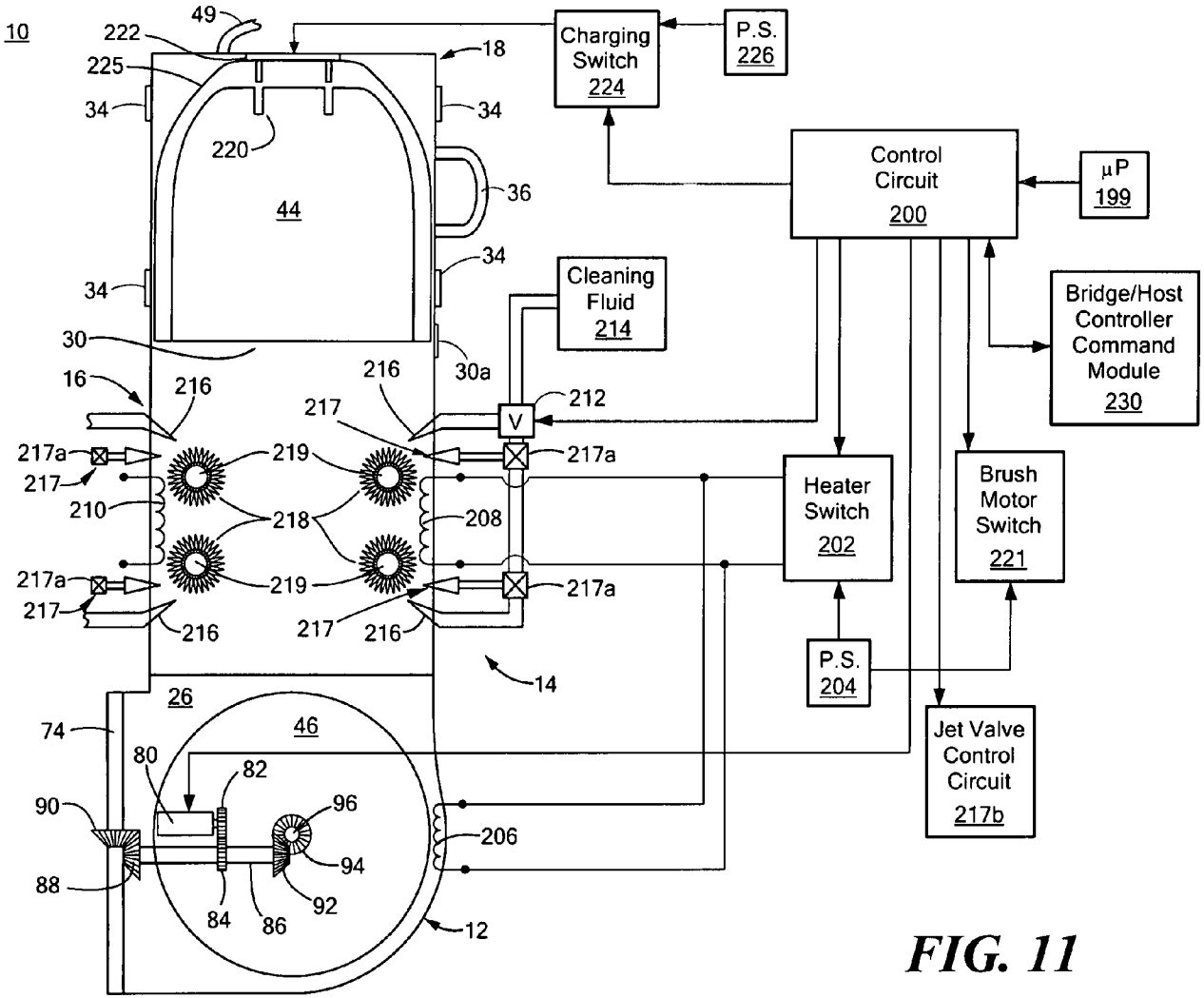
FIG. 11 is a schematic block diagram of the control system for the various features of the garage.

A control circuit 200, FIG. 11, driven for example by a processor 199 associated with garage 10 may be used to operate various features of garage 10. For example, control circuit 200 may operate a heater switch 202 which provides power from a power supply 204 to a heater 206 to warm and deice robot 44 when it is in stowage compartment 12. Heater switch 202 may also operate heaters 208 and 210 in cleaning station 16 also for the purposes of deicing and as well for drying. Control circuit 200 may operate valve 212 which provides cleaning fluid such as fresh water from a cleaning fluid reservoir 214 to various nozzles 216 in cleaning chambers 16 to wash robot 44 when it is resident or moving through cleaning station 16. There may also be provided some sort of cleaning elements such as water jets 217 or rotary brushes 218 driven by brush motors 219 through brush motor switches 221 which apply power from power supply 204, for example, to drive motors 219 to rotate brushes 218. Water jets 217 are operated by valves 217*a* by jet valve controller circuit 217*b*. Cleaning and heating are desirable because of the corrosive nature of salt water and the freezing conditions which are commonly encountered in ocean going vessels. Electronic or mechanical docking may be provided in portable suitcase chamber 18 to allow robot 44 to dock so that its communication and charging receptacle 220 aligns and engages with the communications and charging dock receptacle 222 so that it may charge while it is resident in portable suitcase chamber 18 and may communicate with an on-board host controller and navigation system. This can be done, for example, through a charging switch 224 that senses the presence and engagement of robot 44 and provides power from power supply 226. Mechanical docking may be accomplished by means, for example, of a shaped 225 docking surface to guide robot 44 to a full engagement of its charging receptacle 220 with the docking receptacle 222. Also included in control circuit 200 is a bridge/host controller communications module 230 for communication and navigation.

Figure 12:
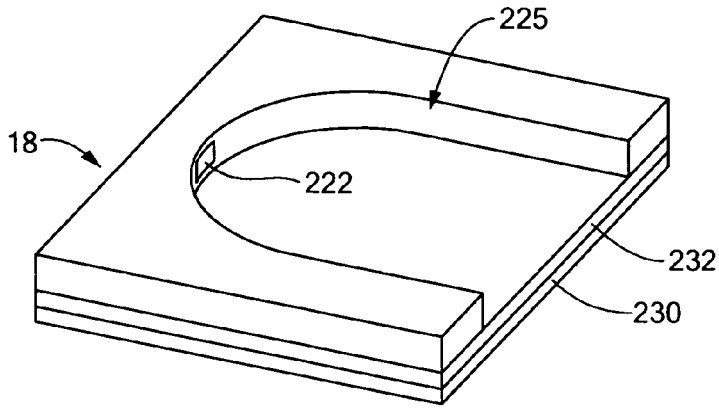
FIG. 12 is a three dimensional view of a portion of the portable suitcase chamber with a magnetic base and insulator layer.
Figure 13:
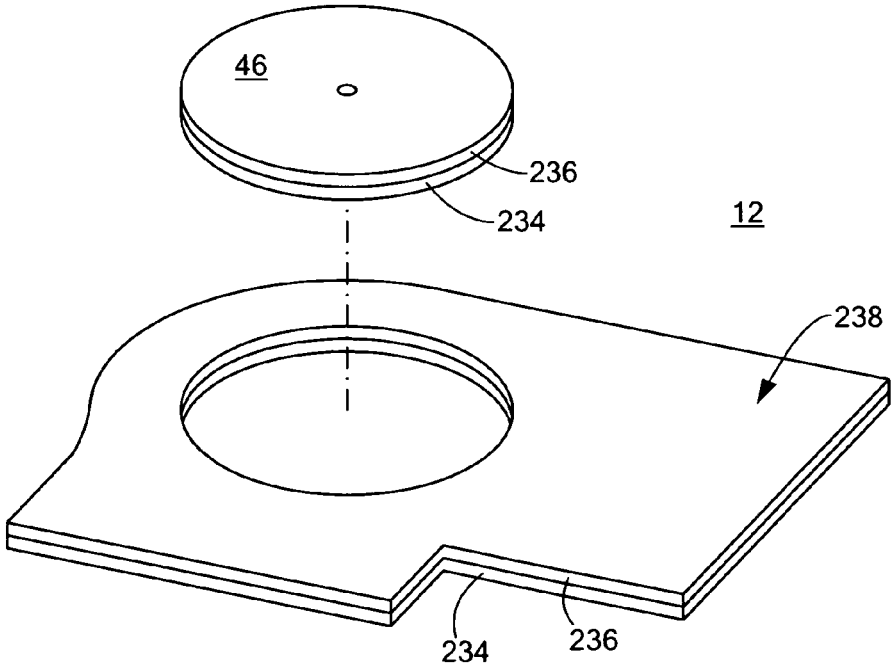
FIG. 13 is a three dimensional view of a portion of the stowage compartment with a magnetic base and insulator layer.

Since the magnets used by hull robot 44 may be quite strong it may be necessary or desirable to reduce the magnetic attraction between the robot and garage 10. For this purpose, for example, portable suitcase chamber 18, FIG. 12, may be provided with a magnetic metal plate 230 and a magnetic spacer plate 232 so that when robot 44 is within the docking area 225 the magnetic force is somewhat reduced to allow the portable suitcase chamber to be more easily removed and more safely carried through the steel ship. A reduction in the magnetic attractive force could also be effected in stowage compartment 12, FIG. 13 through the use of a similar combination of magnetic material 234 covered by a magnetic spacer 236 both in the base 238 and in turntable 46. The spacers may be anything that reduces the magnetic force including non-magnetic material (e.g. air) that creates a gap or a magnetic material such as a magnetic shunt or keeper plate.

While as previously explained, supra, the details of heaters, cleaning fluids and implements and charging sockets have been distributed over all three sections of the garage 10; stowage compartment 12, service chamber 14 and suitcase chamber 18, this is not a necessary limitation of the invention. Both chambers 14 and 18 are eliminated in FIG. 14 and their features carried out with stowage compartment 12*a*. There hinge 20*a* with removable hinge pin 21 and a handle 23 are used to enable stowage compartment 12*a* to perform the function of suitcase chamber 18. Further, optional charging receptacle 220*a*, and cleaning stations 250, 252 including the functions of elements 216, 217, 218 enable stowage compartment 12*a* to perform the functions of the service chamber.

Thus far stowage compartments 12 and 12*a* have been shown substantially enclosed but that is not a necessary limitation for as shown in FIG. 15 stowage compartment 12*b* need only be an open plate 254 without walls. Further it may be driven between the launch/recovery attitude 256 and stowed position 258 by many different systems. In FIG. 15, a hinge 260 connects plate 254 to the vessel and hydraulic cylinders 262, 264 move it about the hinge axis.

Thus, although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A vessel hull robot garage comprising:

a stowage compartment on a deck of the vessel proximate to a portion of a hull of the vessel extending from the deck for stowing a hull robot;

a rotation system configured to rotate said stowage compartment relative to the vessel between a launch/recovery attitude and a stowed position, wherein the stowage compartment in the launch/recovery attitude is operable to launch the hull robot to, and recover the hull robot from, the portion of the hull.

2. The vessel hull robot garage of claim 1 in which said rotation system includes a rotation mechanism and a drive system.

3. The vessel hull robot garage of claim 1 in which said garage includes a cleaning fluid dispenser system for cleaning said robot.

4. The vessel hull robot garage of claim 1 in which said garage includes cleaning implements for cleaning said robot.

5. The vessel hull robot garage of claim 1 in which said garage includes a heater system.

6. The vessel hull robot garage of claim 1 in which said garage includes a charging receptacle for engaging a matching receptacle on said robot for charging the robot power supply.

7. The vessel hull robot garage of claim 1 in which said garage includes a charging and communication receptacle for receiving a matching receptacle on said robot for charging the robot power supply and communicating with an on board host controller and navigation system.

8. The vessel hull robot garage of claim 1 in which the robot garage is disposed on a water borne vessel deck and said launch/recovery attitude is generally parallel to the surface of the hull and the stowed position is generally parallel to the deck.

9. The vessel hull robot garage of claim 1 in which said garage includes a floor of magnetic material.

10. The vessel hull robot garage of claim 9 in which there is a first spacer between the magnetic material and the robot to reduce any magnetic attraction between the robot and vessel.

11. The vessel hull robot garage of claim 9 in which said first spacer is non- magnetic material.

12. The vessel hull robot garage of claim 9 in which said first spacer is a keeper plate.

13. The vessel hull robot garage of claim 1 in which said rotation system includes a hinge one portion of which is fixed to the garage, the other to said vessel.

14. The vessel hull robot garage of claim 1 in which the garage encloses said robot in the stowed position.

15. The vessel hull robot garage of claim 14 in which said garage includes a door driven to move toward the open position as said stowage compartment approaches the launch/recovery attitude and toward the closed position as said stowage compartment approaches the stowed position.

16. The vessel hull robot garage of claim 1 in which the garage includes a service chamber including at least one of a heater, a cleaning fluid dispenser system and a cleaning implement.

17. The vessel hull robot garage of claim 1 in which the garage includes a releasably connected portable suitcase chamber.

18. The vessel hull robot garage of claim 2 in which said stowage compartment includes a turntable for re-orienting the hull robot relative to said stowage compartment.

19. The vessel hull robot garage of claim 18 in which said turntable includes a second rotation mechanism for rotating said turntable.

20. The vessel hull robot garage of claim 19 in which said second rotation mechanism is driven by said drive system.

21. The vessel hull robot garage of claim 20 in which said first and second rotation mechanisms each include a set of gears with a common shaft driven by said drive system.

22. A vessel hull robot garage comprising:

a stowage compartment coupleable to a deck of a vessel proximate to a portion of a hull of the vessel extending from the deck for stowing a hull robot;

a rotation system for rotating said stowage compartment relative to the vessel between a launch/recovery attitude and a stowed position, wherein the stowage compartment in the launch/recovery attitude is operable to launch the hull robot to, and recover the hull robot from, the portion of the hull;

a service chamber for receiving the hull robot for servicing during stowage; and a separate, portable suitcase chamber for extracting the robot from the garage.

* * * * *